US011365701B2

(12) United States Patent
Idogawa et al.

(10) Patent No.: US 11,365,701 B2
(45) Date of Patent: Jun. 21, 2022

(54) ENGINE DEVICE

(71) Applicant: TOYOTA JIDOSHA KABUSHIKI KAISHA, Toyota (JP)

(72) Inventors: Masanao Idogawa, Nagoya (JP); Takahiro Uchida, Okazaki (JP); Koji Ichikawa, Aichi-gun (JP); Hiroaki Mizoguchi, Nagoya (JP); Takuya Okubo, Nissin (JP); Sohichi Imai, Toyota (JP); Hirokazu Andoh, Seto (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/356,660

(22) Filed: Jun. 24, 2021

(65) Prior Publication Data

US 2022/0010749 A1 Jan. 13, 2022

(30) Foreign Application Priority Data

Jul. 7, 2020 (JP) ..... JP2020-117066

(51) Int. Cl.

| | |
|---|---|
| ***F02D 41/40*** | (2006.01) |
| ***F02D 39/06*** | (2006.01) |
| ***F02D 39/08*** | (2006.01) |
| ***F02D 41/38*** | (2006.01) |
| ***F02D 37/02*** | (2006.01) |

(52) U.S. Cl.

CPC ..... *F02D 41/405* (2013.01); *F02D 39/06* (2013.01); *F02D 39/08* (2013.01); *F02D 41/402* (2013.01); *F02D 37/02* (2013.01); *F02D 2041/389* (2013.01); *F02D 2200/021* (2013.01); *F02D 2200/0411* (2013.01)

(58) Field of Classification Search

CPC ..... F02D 41/405; F02D 39/06; F02D 39/08; F02D 41/402; F02D 37/02; F02D 2041/389; F02D 2200/021; F02D 2200/0411; F02D 41/06; F02P 5/045; F02P 5/1506

See application file for complete search history.

(56) References Cited

U.S. PATENT DOCUMENTS

2002/0162320 A1* 11/2002 Uchida ..... F02D 41/024 60/284
2006/0225703 A1* 10/2006 Saito ..... F02D 41/3094 123/431

(Continued)

FOREIGN PATENT DOCUMENTS

JP 2018-131948 A 8/2018

*Primary Examiner* — Phutthiwat Wongwian
*Assistant Examiner* — Susan E Scharpf
(74) *Attorney, Agent, or Firm* — Oliff PLC

(57) ABSTRACT

An engine device includes an engine including an in-cylinder injection valve and a spark plug, an exhaust gas control device, and a controller. The controller is configured to perform a last fuel injection from the in-cylinder injection valve in an expansion stroke and to set a fuel injection amount for the last fuel injection in expansion stroke injection driving, based on a coolant start temperature, post-start time, and volumetric efficiency. The expansion stroke injection driving is a control that is performed by performing the ignition by the spark plug in synchronization with the fuel injection in the expansion stroke.

4 Claims, 3 Drawing Sheets

(56) References Cited

U.S. PATENT DOCUMENTS

| | | | | |
|---|---|---|---|---|
| 2009/0271095 | A1* | 10/2009 | Kojima | F02N 99/006<br>701/113 |
| 2012/0111302 | A1* | 5/2012 | Shishime | F02D 41/405<br>123/299 |
| 2014/0026539 | A1* | 1/2014 | Kurtz | F02D 41/024<br>60/273 |

* cited by examiner

ENGINE DEVICE

CROSS-REFERENCE TO RELATED APPLICATION

This application claims priority to Japanese Patent Application No. 2020-117066 filed on Jul. 7, 2020, incorporated herein by reference in its entirety.

BACKGROUND

1. Technical Field

The present disclosure relates to engine devices.

2. Description of Related Art

An engine device has been proposed which includes an engine having an in-cylinder injection valve for injecting fuel into a combustion chamber and an ignition plug disposed near the top part of the combustion chamber (see, e.g., Japanese Unexamined Patent Application Publication No. 2018-131948 (JP 2018-131948 A)). This engine device retards the ignition timing when knocking is detected while the engine is operating in a stratified charge combustion mode. The stratified charge combustion mode is a mode in which fuel is injected from the in-cylinder injection valve in the compression stroke to form a stratified air-fuel mixture near the spark plug and stratified charge combustion is performed. When the amount of retard of the fuel injection timing according to the ignition timing is smaller than a reference amount, the fuel injection in the compression stroke is performed at the fuel injection timing retarded according to the amount of retard.

SUMMARY

The above engine device typically retards the ignition timing when warming up an exhaust gas control device having a catalyst for controlling exhaust gases, in order to supply more heat to the exhaust gas control device. In the above engine device, the expansion stroke may be selected as the ignition timing. In this case, it is possible that more than half of the fuel injection amount determined by, e.g., the engine load factor is injected in one or more injections in the intake stroke or the compression stroke and the last fuel injection is performed in the compression stroke or the expansion stroke. The fuel injection in the expansion stroke may be performed not only when warming up the exhaust gas control device but also when, for example, starting the engine. It is necessary to set the fuel injection amount for the fuel injection in the expansion stroke more appropriately because when the fuel injection amount is too small, discharge may not be induced, and when the fuel injection amount is too large, fine particles such as soot may be produced from incomplete combustion.

The present disclosure provides an engine device that sets the fuel injection amount for fuel injection in the expansion stroke more appropriately.

An engine device of one aspect of the present disclosure includes: an engine including an in-cylinder injection valve configured to spray fuel into a combustion chamber and a spark plug configured to ignite the fuel sprayed from the in-cylinder injection valve; an exhaust gas control device including an exhaust gas control catalyst configured to control exhaust gases from the engine; and a controller configured to control a plurality of fuel injections from the in-cylinder injection valve and ignition by the spark plug. The controller is configured to perform a last fuel injection from the in-cylinder injection valve in an expansion stroke and to set a fuel injection amount for the last fuel injection in expansion stroke injection driving, based on a coolant start temperature, post-start time, and volumetric efficiency, the coolant start temperature being a temperature of a coolant for the engine when the engine is started, the post-start time being time elapsed since the start of the engine, the volumetric efficiency being a ratio of a volume of air actually drawn in one cycle to a stroke volume per cycle of the engine. The expansion stroke injection driving is a control that is performed by performing the ignition by the spark plug in synchronization with the fuel injection in the expansion stroke.

In the engine device of the one aspect of the present disclosure, the last fuel injection from the in-cylinder injection valve is performed in the expansion stroke, and the fuel injection amount for the last fuel injection in the expansion stroke injection driving in which the ignition by the spark plug is performed in synchronization with the fuel injection in the expansion stroke is set based on: the coolant start temperature that is the temperature of the coolant for the engine when the engine is started; the post-start time that is the time elapsed since the start of the engine; and the volumetric efficiency that is the ratio of the volume of air actually drawn in one cycle to the stroke volume per cycle of the engine. The coolant start temperature reflects the temperature inside a cylinder at the start of the engine (initial value of the temperature inside the cylinder), the post-start time reflects the temperature inside the cylinder after the start of the engine, and the volumetric efficiency reflects the intake air amount. Since the fuel injection amount for the last fuel injection is set based on the coolant start temperature, the post-start time, and the volumetric efficiency, the fuel injection amount for the last fuel injection can be set to a more appropriate amount.

In the engine device of the one aspect of the present disclosure, the controller may be configured to set the fuel injection amount for the last fuel injection in the expansion stroke injection driving in such a manner that the higher the coolant start temperature, the larger the fuel injection amount for the last fuel injection tends to be, that the longer the post-start time, the smaller the fuel injection amount for the last fuel injection tends to be, and that the higher the volumetric efficiency, the larger the fuel injection amount for the last fuel injection tends to be. According to the engine device of the one aspect of the present disclosure, the reason why the fuel injection amount for the last fuel injection in the expansion stroke injection driving is set in such a manner that the higher the coolant start temperature, the larger the fuel injection amount for the last fuel injection tends to be is based on the fact that the higher the coolant start temperature, the less fine particles such as soot are produced. The reason why the fuel injection amount for the last fuel injection in the expansion stroke injection driving is set in such a manner that the longer the post-start time, the smaller the fuel injection amount for the last fuel injection tends to be is based on the fact that the longer the post-start time, the more the inside of the cylinder is warmed. The reason why the fuel injection amount for the last fuel injection in the expansion stroke injection driving is set in such a manner that the higher the volumetric efficiency, the larger the fuel injection amount for the last fuel injection tends to be is based on the fact that, in order to spread combustion in the entire cylinder after a pilot flame is ignited by the ignition, a larger pilot flame is considered necessary as the volumetric efficiency increases.

In the engine device of the one aspect of the present disclosure, the controller may be configured to control an opening degree of the in-cylinder injection valve to fully open for the fuel injections other than the last fuel injection in the expansion stroke injection driving, and to control the opening degree of the in-cylinder injection valve to partially open for the last fuel injection. As used herein, "partially open" means that the valve is not fully opened, and includes the opening degrees of 5%, 10%, 20%, 50%, etc.

In the engine device of the one aspect of the present disclosure, the controller may be configured to correct fuel injection amounts for the fuel injections other than the last fuel injection in the expansion stroke injection driving by air-fuel ratio feedback control, and not to correct the fuel injection amount for the last fuel injection in the expansion stroke injection driving by the air-fuel ratio feedback control. According to the engine device of the one aspect of the present disclosure, since the last fuel injection is performed in order to induce discharge for the ignition by the spark plug, it is not necessary to correct the fuel injection amount for the last fuel injection by the air-fuel ratio feedback control. On the other hand, since it is necessary to correct total fuel injection amounts for the fuel injections by the air-fuel ratio feedback control, the fuel injection amounts for the fuel injections other than the last fuel injection are corrected by the air-fuel ratio feedback control.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein.

DETAILED DESCRIPTION OF EMBODIMENTS

Next, a mode for carrying out the present disclosure will be described using an embodiment.

Figure 1:
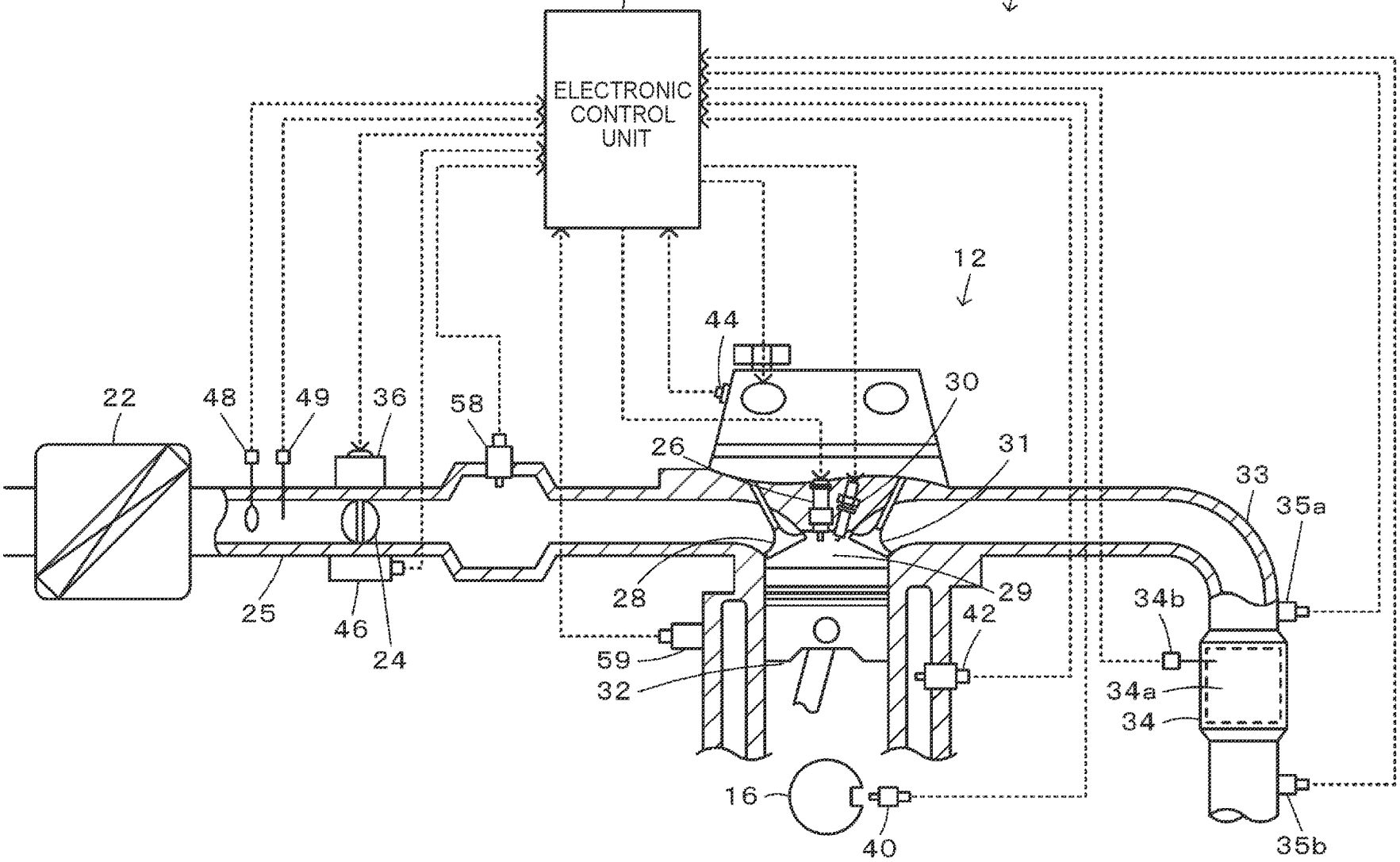
FIG. 1 is a configuration diagram schematically illustrating the configuration of an engine device 10 according to an embodiment of the present disclosure.

FIG. 1 is a configuration diagram schematically illustrating the configuration of an engine device 10 according to an embodiment of the present disclosure. As shown in the figure, the engine device 10 of the embodiment includes an engine 12 and an electronic control unit (hereinafter referred to as "ECU") 70 for controlling the engine 12. The engine device 10 is mounted on, e.g., an automobile that runs only on the power from the engine 12, a hybrid vehicle that has a motor in addition to the engine 12, and construction equipment that runs on the power from the engine 12. The embodiment will be described on the assumption that the engine device 10 is mounted on an automobile. The ECU 70 is an example of the controller.

The engine 12 is configured as an internal combustion engine that uses fuel such as gasoline or light oil to output power in four strokes, namely intake, compression, expansion, and exhaust strokes. The engine 12 has an in-cylinder injection valve 26 for injecting fuel into a cylinder and a spark plug 30. The in-cylinder injection valve 26 is disposed substantially in the center of the top part of a combustion chamber 29 and sprays fuel. The spark plug 30 is disposed near the in-cylinder injection valve 26 so that the spark plug 30 can ignite the fuel sprayed from the in-cylinder injection valve 26. The engine 12 draws air cleaned by an air cleaner 22 into the combustion chamber 29 via an intake pipe 25, injects fuel from the in-cylinder injection valve 26 in one or more injections in the intake stroke or the compression stroke, ignites and burns the air-fuel mixture by an electric spark from the spark plug 30, and converts the reciprocating motion of a piston 32 pushed downward by the energy of the expanding gases into rotary motion of a crankshaft 16. The engine 12 is an example of the engine.

Exhaust gases discharged from the combustion chamber 29 of the engine 12 to an exhaust pipe 33 are discharged to the atmosphere through an exhaust gas control device 34 having an exhaust gas control catalyst (three-way catalyst) 34*a* for removing harmful components such as carbon monoxide (CO), hydrocarbons (HCs), and nitrogen oxides (NOx) from the exhaust gases. The exhaust gas control device 34 is an example of the exhaust gas control device.

Although not shown in the figure, the ECU 70 is configured as a microprocessor mainly composed of a central processing unit (CPU), and includes a read-only memory (ROM) storing processing programs, a random access memory (RAM) for temporarily storing data, and input and output ports in addition to the CPU. Signals from various sensors required to control the engine 12 are input to the ECU 70 via the input port. Some examples of the signals that are input to the ECU 70 include: a crank angle θcr from a crank position sensor 40 for detecting the rotational position of the crankshaft 16; a coolant temperature Tw from a coolant temperature sensor 42 for detecting the temperature of a coolant for the engine 12; and cam angles θci, θco from a cam position sensor 44 for detecting the rotational position of an intake camshaft that opens and closes an intake valve 28 and the rotational position of an exhaust camshaft that opens and closes an exhaust valve 31. Other examples of the signals include: a throttle valve opening degree TH from a throttle valve position sensor 46 for detecting the position of a throttle valve 24 disposed in the intake pipe 25; an intake air amount Qa from an air flow meter 48 attached to the intake pipe 25; an intake air temperature Ta from a temperature sensor 49 attached to the intake pipe 25; and an intake air pressure Pin from an intake air pressure sensor 58 for detecting the pressure in the intake pipe 25. Other examples of the signals further include: a catalyst temperature Tc from a temperature sensor 34*b* for detecting the temperature of the exhaust gas control catalyst 34*a* of the exhaust gas control device 34; an air-fuel ratio AF from an air-fuel ratio sensor 35*a* attached to the exhaust pipe 33; an oxygen signal O2 from an oxygen sensor 35*b* attached to the exhaust pipe 33; and a knock signal Ks from a knock sensor 59, attached to a cylinder block, for detecting vibration caused by knocking.

Various control signals for controlling the engine 12 are output from the ECU 70 via the output port. Examples of the signals that are output from the ECU 70 include: a drive control signal for a throttle motor 36 for adjusting the position of the throttle valve 24; a drive control signal for the in-cylinder injection valve 26; and a drive control signal for the spark plug 30.

The ECU 70 calculates the rotational speed of the crankshaft 16, that is, the rotational speed Ne of the engine 12, based on the crank angle θcr from the crank position sensor 40. The ECU 70 also calculates the volumetric efficiency (the ratio of the volume of air actually drawn in one cycle to the stroke volume per cycle of the engine 12) KL that is the load of the engine 12, based on the intake air amount Qa from the air flow meter 48 and the rotational speed Ne of the engine 12.

The ECU 70 of the engine device 10 configured as described above performs intake air amount control, fuel injection control, and ignition control for the engine 12 so that the engine 12 is operated based on a desired rotational speed Ne* and desired torque Te*. In the intake air amount control, the ECU 70 sets a desired air amount Qa* based on the desired torque Te* of the engine 12, sets a desired throttle valve opening degree TH* for controlling the intake air amount Qa to the desired air amount Qa*, and controls the throttle motor 36 to control the throttle valve opening degree TH of the throttle valve 24 to the desired throttle valve opening degree TH*. In the fuel injection control, the ECU 70 sets a desired fuel injection amount Qfd* of the in-cylinder injection valve 26 for controlling the air-fuel ratio AF to a desired air-fuel ratio AF* (e.g., stoichiometric air-fuel ratio), based on the rotational speed Ne of the engine 12 and the volumetric efficiency KL, and controls the in-cylinder injection valve 26 so that the desired fuel injection amount Qfd* is injected from the in-cylinder injection valve 26 in one or more fuel injections. In many in-cylinder injection valves, the valve opening degree is adjusted by lifting a needle valve. In this case, the fully open state of the in-cylinder injection valve is called full lift and the partially open state of the in-cylinder injection valve is called partial lift. In the ignition control, the ECU 70 sets desired ignition timing Tp* based on the rotational speed Ne of the engine 12 and the volumetric efficiency KL, and controls ignition by the spark plug 30.

Next, the operation of the engine device 10 of the embodiment configured as described above, particularly the operation of the engine device 10 when rapidly warming up the exhaust gas control catalyst (three-way catalyst) 34*a* of the exhaust gas control device 34, will be described. The rapid warm-up of the exhaust gas control device 34 is performed when a condition that a catalyst temperature Tc is equal to or lower than a predetermined temperature below the temperature at which the exhaust gas control catalyst 34*a* is activated or an accelerator-off condition is satisfied. Either expansion stroke injection warm-up or compression stroke injection warm-up is selected to perform the rapid warm-up. The expansion stroke injection warm-up is a process in which fuel injection is performed one to three times in the intake stroke or the compression stroke, the last fuel injection is performed in the expansion stroke, and ignition is performed in synchronization with this fuel injection in the expansion stroke. The compression stroke injection warm-up is a process in which fuel injection is performed one to three times in the intake stroke or the compression stroke, the last fuel injection is performed in the compression stroke, and ignition is performed in the expansion stroke following the compression stroke. This selection is made according to the coolant temperature Tw at the start of the engine 12, the shift position, etc. For example, when the coolant temperature Tw at the start of the engine 12 is lower than a predetermined temperature (e.g., 35° C. or 45° C.), the expansion stroke injection warm-up is selected in order to warm up the exhaust gas control catalyst 34*a* more quickly and improve emissions. When the coolant temperature Tw at the start of the engine 12 is equal to or higher than the predetermined temperature, the compression stroke injection warm-up is selected in order to maintain satisfactory emissions. The above predetermined temperature may be switched so that the expansion stroke injection warm-up is more likely to be selected when the shift position is a non-drive position (neutral (N) position or parking (P) position) than when the shift position is a drive position (drive (D) position or reverse (R) position). The expansion stroke injection warm-up is an example of the expansion stroke injection driving.

Such rapid warm-up is controlled so as to retard the ignition timing Tp as much as possible. Since retarding the ignition timing Tp decreases the combustion efficiency, the intake air amount is increased to maintain the rotational speed Ne of the engine 12. As a result, the amount of burnt gases increases and the absolute amount of emission components also increases, but catalyst warm-up is facilitated. In the compression stroke injection warm-up, the exhaust gas control catalyst 34*a* is warmed up while maintaining satisfactory emissions. The amount of retard of the ignition timing Tp in the compression stroke injection warm-up is therefore smaller than in the expansion stroke injection warm-up. In the expansion stroke injection warm-up, an ignition timing base value Tpb is set based on the coolant temperature at the start of the engine 12 (hereinafter, also referred to as the "coolant start temperature Tws") and the time Tel elapsed since the start of the engine 12 (hereinafter, also referred to as the "post-start time Tel"), and desired ignition timing Tp* is set by subtracting a correction value Tpfb obtained by feedback control based on the rotational speed Ne of the engine 12 from the ignition timing base value Tpb. The ignition timing base value Tpb is set so that the lower the coolant start temperature Tws, the more the ignition timing base value Tpb tends to be on the advance side (the higher the coolant start temperature Tws, the more the ignition timing base value Tpb tends to be on the retard side), and so that the longer the post-start time Tel, the more the ignition timing base value Tpb tends to be on the retard side (the shorter the post-start time Tel, the more the ignition timing base value Tpb tends to be on the advance side). The ignition timing base value Tpb may be set so that the ignition timing base value Tpb is more on the retard side when the shift position SP is the non-drive position (N position or P position) than when the shift position SP is the drive position (D position or R position). The ignition timing feedback control is a control in which the ignition timing Tp is advanced or retarded in a direction in which the difference between the rotational speed Ne of the engine 12 and the desired rotational speed Ne* (e.g., 1,500 rpm) is eliminated. This feedback control is composed of a proportional term and an integral term. The correction value Tpfb for the ignition timing feedback control is set to a value that corrects the ignition timing Tp to the retard side when the rotational speed Ne of the engine 12 is higher than the desired rotational speed Ne* and that corrects the ignition timing Tp to the advance side when the rotational speed Ne of the engine 12 is lower than the desired rotational speed Ne*. In the compression stroke injection warm-up, the ignition timing Tp can be determined in a manner similar to that in the expansion stroke injection warm-up. However, the amount of retard of the ignition timing Tp in the compression stroke injection warm-up is smaller than in the expansion stroke injection warm-up, as described above.

Figure 2:
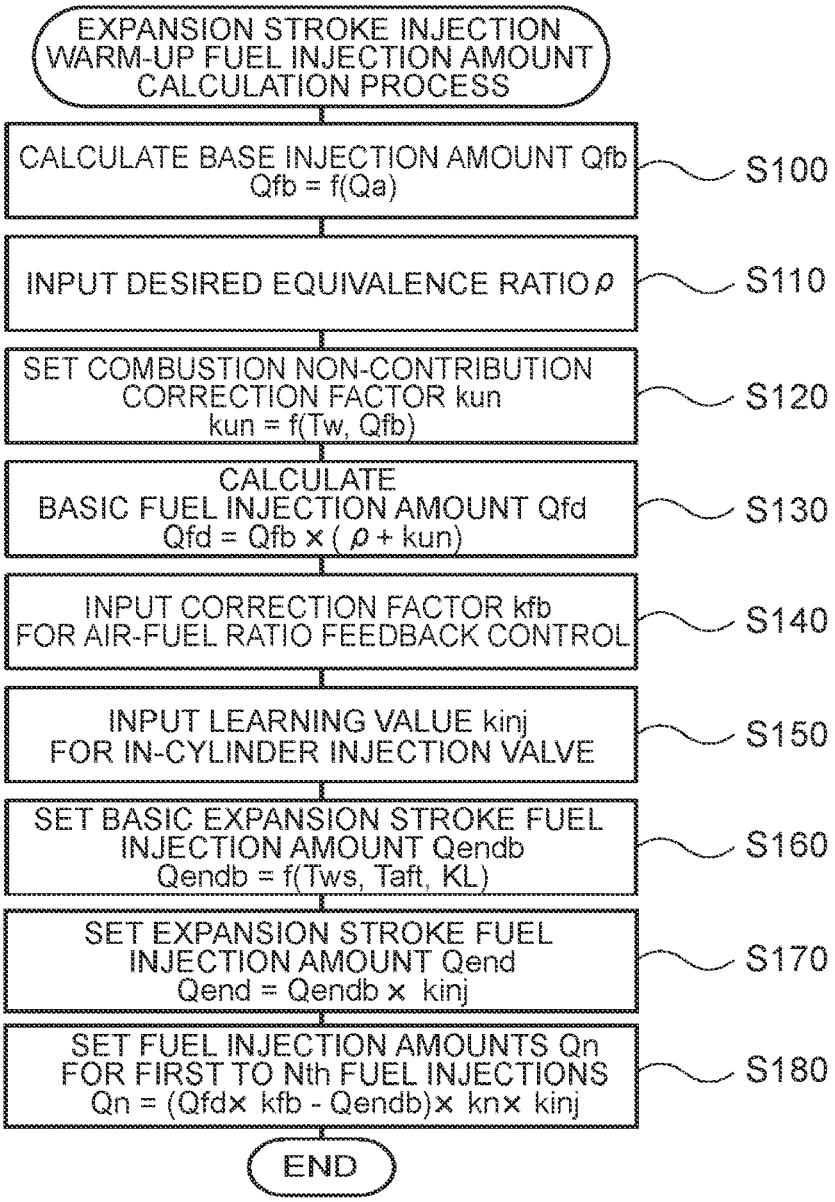
FIG. 2 is a flowchart of an example of an expansion stroke injection warm-up fuel injection amount calculation process that is executed by the ECU 70.

Next, the fuel injection amount for the expansion stroke injection warm-up will be described. FIG. 2 is a flowchart of an example of a process of calculating the fuel injection amount for the expansion stroke injection warm-up (hereinafter, referred to as the "expansion stroke injection warm-up fuel injection amount calculation process") that is executed by the ECU 70 when rapidly warming up the exhaust gas control device 34 by the expansion stroke injection warm-up. The ECU 70 repeatedly executes the expansion stroke injection warm-up fuel injection amount calculation process at, e.g., every predetermined crank angle.

When the ECU 70 executes the expansion stroke injection warm-up fuel injection amount calculation process, the ECU 70 calculates a base injection amount Qfb (step S100), inputs a desired equivalence ratio ρ (step S110), and sets a fuel non-contribution correction factor kun (step S120). The base injection amount Qfb can be calculated as a fuel injection amount corresponding to the stoichiometric air-fuel ratio, based on, e.g., the intake air amount Qa. The desired equivalence ratio ρ is given by "desired air-fuel ratio/stoichiometric air-fuel ratio," and the ECU 70 can input the desired equivalence ratio ρ set to the rich side (higher than the value "1") or the lean side (lower than the value "1") depending on, e.g., the power requested to the engine 12 at that time by the volumetric efficiency KL etc. The desired equivalence ratio ρ can be used synonymously with a combustion contribution correction factor kcon. The combustion contribution correction factor kcon is the ratio of the fuel injection amount that contributes to combustion to the base injection amount Qfb. The combustion non-contribution correction factor kun is calculated as the ratio of the base injection amount Qb to the amount of fuel that adheres to the wall surface of the cylinder of the engine 12 and the upper surface of the piston and that does not contribute to combustion. In the embodiment, the relationship between the combustion non-contribution correction factor kun and the coolant temperature Tw for the engine 12 and the base injection amount Qfb is obtained in advance by experiments etc. and is stored in advance as a map for setting the combustion non-contribution correction factor kun. When the coolant temperature Tw or the base injection amount Qfb is given, the combustion non-contribution correction factor kun is set to a corresponding correction factor derived from the map. In the map for setting the combustion non-contribution correction factor kun of the embodiment, the combustion non-contribution correction factor kun is set so that the higher the coolant temperature Tw, the smaller the combustion non-contribution correction factor kun tends to be, and so that the larger the base injection amount Qfb, the smaller the combustion non-contribution correction factor kun tends to be. This is based on the fact that the higher the coolant temperature Tw for the engine 12, the smaller the amount of fuel that adheres to the wall surface of the cylinder and the upper surface of the piston, and the fact that the amount of fuel that adheres to the wall surface of the cylinder and the upper surface of the piston is the same regardless of the base injection amount Qfh.

Next, a basic fuel injection amount Qfd is calculated by multiplying the base injection amount Qfh by a fuel correction factor kf, as given by the following equation (1) (step S130). The fuel correction factor kf is the sum of the desired equivalence ratio ρ and the combustion non-contribution correction factor kun (kf=ρ+kun). The combustion non-contribution correction factor kun decreases as the coolant temperature Tw for the engine 12 increases with time. The sum of the desired equivalence ratio ρ and the combustion non-contribution correction factor kun therefore means a fuel reduction correction factor. However, the desired equivalence ratio ρ (combustion contribution correction factor kcon) and the combustion non-contribution correction factor kun are obtained individually. Accordingly, when the desired equivalence ratio ρ (combustion contribution correction factor kcon) changes due to, e.g., traveling of the vehicle, the deviation between the sum of the amount of fuel that contributes to combustion and the amount of fuel that does not contribute to combustion and the basic fuel injection amount Qfd is smaller than in the case where the fuel reduction correction factor is obtained from a map.

$$Qfd = Qfh \times (\rho + kun) \quad (1)$$

Subsequently, the ECU 70 inputs a feedback correction factor kfb for air-fuel ratio feedback control (step S140) and inputs a learning value kinj for correcting variation among the in-cylinder injection valves 26 (step S150). The air-fuel ratio feedback control is a control in which the difference between the desired air-fuel ratio AF* and the air-fuel ratio AF from the air-fuel ratio sensor 35*a* is reduced. The feedback correction factor kfb is calculated by the proportional and integral terms on the difference (AF*−AF). The learning value kinj is calculated based on the difference between the desired air-fuel ratio AF* and the air-fuel ratio AF from the air-fuel ratio sensor 35*a*.

Figure 3:
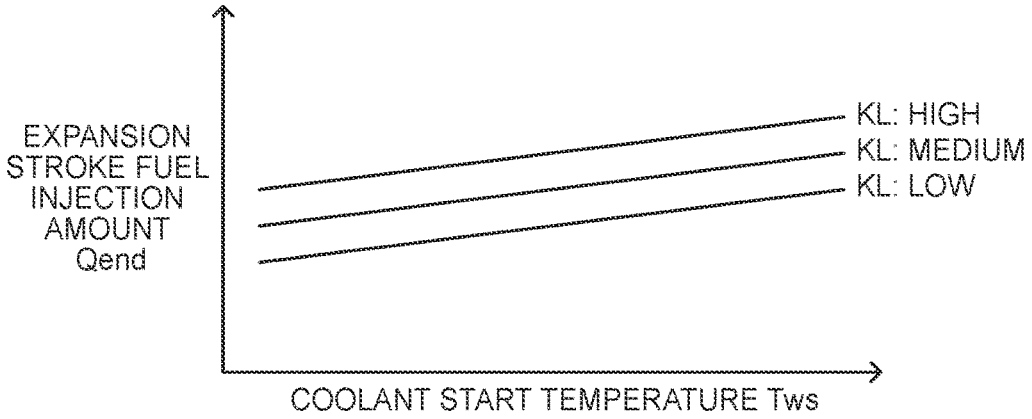
FIG. 3 is a graph illustrating an example of the relationship among a coolant start temperature Tws, volumetric efficiency KL, and a basic expansion stroke fuel injection amount Qendb immediately after the start of an engine 12.
Figure 4:
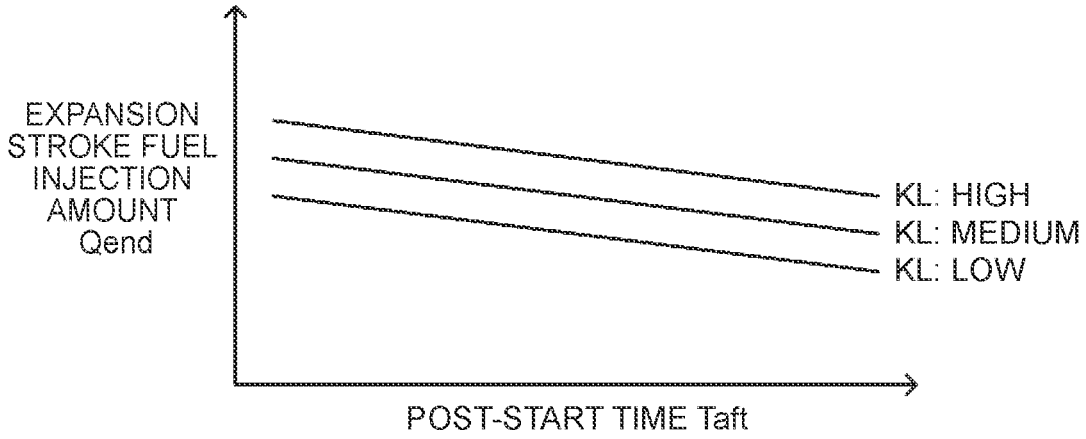
FIG. 4 is a graph illustrating an example of the relationship among post-start time Taft, the volumetric efficiency KL, and the basic expansion stroke fuel injection amount Qendb.

The ECU 70 then sets a basic expansion stroke fuel injection amount Qendb for the last fuel injection in the expansion stroke, based on the coolant temperature at the start of the engine 12 (coolant start temperature Tws), the time Taft elapsed since the start of the engine 12 (post-start time Taft), and the volumetric efficiency KL (step S160). In the embodiment, the relationship among the coolant start temperature Tws, the post-start time Taft, the volumetric efficiency KL, and the basic expansion stroke fuel injection amount Qendb is obtained in advance by experiments etc. and is stored in advance as a map for setting the basic expansion stroke fuel injection amount Qendb. When the coolant start temperature Tws, the post-start time Taft, and the volumetric efficiency KL are given, the basic expansion stroke fuel injection amount Qendb is set to a corresponding basic expansion stroke fuel injection amount Qendb derived from the map. FIG. 3 is a graph illustrating an example of the relationship among the coolant start temperature Tws, the volumetric efficiency KL, and the basic expansion stroke fuel injection amount Qendb immediately after the start of the engine 12. FIG. 4 is a graph illustrating an example of the relationship among the post-start time Taft, the volumetric efficiency KL, and the basic expansion stroke fuel injection amount Qendb. In the embodiment, the basic expansion stroke fuel injection amount Qendb is set so that the higher the coolant start temperature Tws, the larger the basic expansion stroke fuel injection amount Qendb tends to be, so that the longer the post-start time Taft, the smaller the basic expansion stroke fuel injection amount Qendb tends to be, and so that the higher the volumetric efficiency KL, the larger the basic expansion stroke fuel injection amount Qendb tends to be. The reason why the basic expansion stroke fuel injection amount Qendb is set so that the higher the coolant start temperature Tws, the larger the basic expansion stroke fuel injection amount Qendb tends to be is based on the fact that the higher the coolant start temperature Tws, the less fine particles such as soot in the exhaust gases.

The reason why the basic expansion stroke fuel injection amount Qendb is set so that the longer the post-start time Taft, the smaller the basic expansion stroke fuel injection amount Qendb tends to be is based on the fact that the longer the post-start time Taf, the more the inside of the cylinder is warmed. The reason why the basic expansion stroke fuel injection amount Qendb is set so that the higher the volumetric efficiency KL, the larger the basic expansion stroke fuel injection amount Qendb tends to be is based on the fact that, in order to spread combustion in the entire cylinder after a pilot flame is ignited by ignition, a larger pilot flame is considered necessary as the volumetric efficiency KL increases. Since the basic expansion stroke fuel injection amount Qendb can be an amount (very small amount) small enough to induce discharge by ignition, the basic expansion stroke fuel injection amount Qendb is very small as compared to the fuel injection amounts for the first to Nth fuel injections.

After setting the basic expansion stroke fuel injection amount Qendb, the ECU 70 sets an expansion stroke fuel injection amount Qend by multiplying the basic expansion stroke fuel injection amount Qendb by the learning value kinj (step S170). Multiplying the basic expansion stroke fuel injection amount Qendb by the learning value kinj reduces variation among the in-cylinder injection valves 26. Since the expansion stroke fuel injection amount Qend is calculated based on the basic expansion stroke fuel injection amount Qendb, the expansion stroke fuel injection amount Qend is set so that the higher the coolant start temperature Tws, the larger the expansion stroke fuel injection amount Qend tends to be, so that the longer the post-start time Taft, the smaller the expansion stroke fuel injection amount Qend tends to be, and so that the higher the volumetric efficiency KL, the larger the expansion stroke fuel injection amount Qend tends to be.

Figure 5:
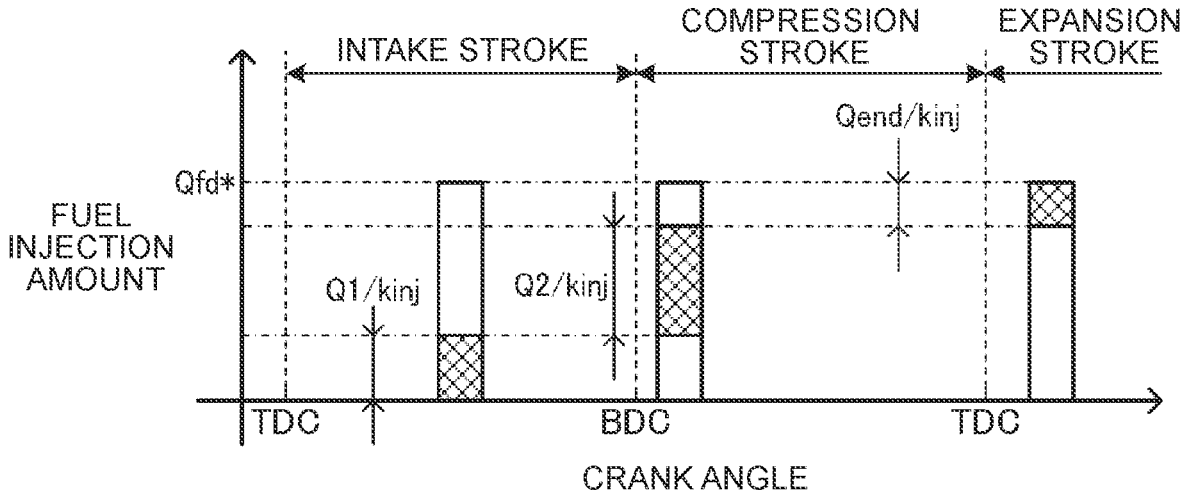
FIG. 5 is a graph illustrating an example of fuel injection timings in crank angle for three fuel injections and fuel injection amounts of the three fuel injections.

The ECU 70 then sets the fuel injection amounts Qn for the first to Nth fuel injections other than the last fuel injection (step S170). The fuel injection amounts Qn for the first to the Nth fuel injections can be obtained by subtracting the basic expansion stroke fuel injection amount Qendb from the basic fuel injection amount Qfd multiplied by the correction value kfb for the air-fuel ratio feedback control, and multiplying the subtraction result by a split proportion kn and the learning value kinj. The sum of the split proportion k1 for the first fuel injection to the split proportion kn for the Nth fuel injection is equal to the value "1," and the split proportion kn is adjusted by the coolant start temperature Tws, the post-start time Taft, and the shift position SP. In the embodiment, the relationship between the split proportion kn and the coolant start temperature Tws, the post-start time Taft, and the shift position SP is determined in advance by experiments etc. and is stored in advance as a map for setting the split proportion kn. When the coolant start temperature Tws, the post-start time Taft, or the shift position SP is given, the split proportion kn is set to a corresponding split proportion derived from the map. It is herein assumed that, of three fuel injections, the third fuel injection is the last fuel injection in the expansion stroke, the first fuel injection is the fuel injection in an intermediate stage of the intake stroke, and the second fuel injection is the fuel injection in an early stage of the compression stroke. FIG. 5 illustrates an example of the fuel injection timings in crank angle for the three fuel injections and the fuel injection amounts for the three fuel injections. In the figure, the hatched portions correspond to the fuel injection amounts for the first, second, and last fuel injections. In the figure, the fuel injection amounts for the first, second, and last fuel injections are shown as fuel injection amounts Q1, Q2, and Qend divided by the learning value kinj for reducing variation among the in-cylinder injection valves 26. In this case, in the embodiment, the split proportion k1 for the first fuel injection is set so that the lower the coolant start temperature Tws, the larger the split proportion k1 tends to be, so that the longer the post-start time Taft, the smaller the split proportion k1 tends to be, and so that the split proportion k1 tends to be larger when the shift position SP is the drive position (D position or R position) than when the shift position SP is the non-drive position (N position or P position). The reason why the split proportion k1 for the first fuel injection is set so that the lower the coolant start temperature Tws, the larger the split proportion k1 tends to be is based on the fact that the lower the coolant start temperature Tws, the more fuel tends to adhere to the wall surface of the cylinder and the upper surface of the piston, and therefore the adhesion of fuel can be reduced as compared to the case where fuel injection is performed in the compression stroke. The reason why the split proportion k1 for the first fuel injection is set so that the longer the post-start time Taft, the smaller the split proportion k1 tends to be is based on the fact that the longer the post-start time Taft, the higher the temperature inside the cylinder, and therefore a smaller amount of fuel adheres to the wall surface of the cylinder and the upper surface of the piston even in the fuel injection in the compression stroke. The reason why the split proportion k1 for the first fuel injection is set so that the split proportion k1 tends to be larger when the shift position SP is the drive position (D position or R position) than when the shift position SP is the non-drive position (N position or P position) is based on the fact that, since the volumetric efficiency KL is larger when the shift position SP is the drive position (D position or R position) than when the shift position SP is the non-drive position (N position or P position), the air-fuel mixture is made richer and more uniform. The reason why the correction factor kfb for the air-fuel ratio feedback control is taken into consideration for the fuel injection amounts for the first to Nth fuel injections and is not taken into consideration for the fuel injection amount Qend for the last fuel injection (expansion stroke fuel injection amount Qend) is based on the fact that, since the last fuel injection is performed in order to induce discharge for ignition by the spark plug 30, it is not necessary to perform the air-fuel ratio feedback control on the fuel injection amount for the last fuel injection. The air-fuel ratio AF from the air-fuel ratio sensor 35*a* can be controlled to the desired air-fuel ratio AF* by taking the correction factor kfb for the air-fuel ratio feedback control into consideration for the fuel injection amounts for the first to Nth fuel injections. Correcting the fuel injection amounts Qn for the first to Nth fuel injections by the learning value kinj reduces variation among the in-cylinder injection valves 26.

When the fuel injection amount for the last fuel injection (expansion stroke fuel injection amount Qend) and the fuel injection amounts Qn for the first to Nth fuel injections are set in this manner, each of the first to Nth fuel injections is performed by fully opening the in-cylinder injection valve 26 (full lift) at a corresponding one of the set fuel injection start timings (fuel injection start timings set for the intake stroke and the compression stroke) and closing the in-cylinder injection valve 26 when the time according to a corresponding one of the fuel injection amounts Qn has elapsed. The reason why the first to Nth fuel injections are performed with the in-cylinder injection valve 26 fully opened (full lift) is based on the need to accurately inject a certain amount of fuel. In the last fuel injection (fuel injection in the expansion stroke), the in-cylinder injection valve 26 is partially opened (partial lift) in synchronization with the ignition timing of the spark plug 30, that is, at a timing slightly earlier than the ignition timing (e.g., two or three degrees earlier in crank angle) so that discharge is induced, and the in-cylinder injection valve 26 is closed when the time according to the fuel injection amount for the last fuel injection (expansion stroke fuel injection amount Qend) has elapsed. The reason why the last fuel injection (fuel injection in the expansion stroke) is performed with the in-cylinder injection valve 26 partially opened (partial lift) is based on the fact that the last fuel injection is performed in order to induce discharge and that it is preferable to spray as small fuel particles as possible in the last fuel injection. As used herein, "partially opened (partial lift)" means that the valve is not fully opened, and includes the opening degrees of 5%, 10%, 20%, etc. In the embodiment, it is assumed that, when fuel injection is performed with the in-cylinder injection valve 26 partially opened (partial lift), the in-cylinder injection valve 26 is opened to an opening degree determined in advance by experiments etc.

In the engine device 10 of the embodiment described above, when the exhaust gas control device 34 is warmed up by the expansion stroke injection warm-up, the fuel injection amount for the last fuel injection (expansion stroke fuel injection amount Qend) is set based on the coolant start temperature Tws, the post-start time Taft, and the volumetric efficiency KL. The coolant start temperature Tws reflects the temperature inside the cylinder at the start of the engine 12 (the initial value of the temperature inside the cylinder), the post-start time Taft reflects the temperature inside the cylinder after the start of the engine 12, and the volumetric efficiency KL reflects the intake air amount Qa. Since the fuel injection amount for the last fuel injection (expansion stroke fuel injection amount Qend) is set based on the coolant start temperature Tws, the post-start time Taft, and the volumetric efficiency KL, the fuel injection amount for the last fuel injection (expansion stroke fuel injection amount Qend) can be set to a more appropriate amount. The fuel injection amount for the last fuel injection (expansion stroke fuel injection amount Qend) is set so that the higher the coolant start temperature Tws, the larger the fuel injection amount for the last fuel injection (expansion stroke fuel injection amount Qend) tends to be, so that the longer the post-start time Taft, the smaller the fuel injection amount for the last fuel injection (expansion stroke fuel injection amount Qend) tends to be, and so that the higher the volumetric efficiency KL, the larger the fuel injection amount for the last fuel injection (expansion stroke fuel injection amount Qend) tends to be. The fuel injection amount for the last fuel injection (expansion stroke fuel injection amount Qend) can thus be set to a more appropriate amount.

In the engine device 10 of the embodiment, the first to Nth fuel injections are performed with the in-cylinder injection valve 26 fully opened (full lift). The first to Nth fuel injections can thus be performed more accurately. The last fuel injection (fuel injection in the expansion stroke) is performed with the in-cylinder injection valve 26 partially opened (partial lift). A very small amount of fine particles can thus be injected in the last fuel injection, and discharge can be more reliably induced.

In the engine device 10 of the embodiment, the fuel injection amount for the last fuel injection (expansion stroke fuel injection amount Qend) is not corrected by the air-fuel ratio feedback control, but is corrected by the learning value kinj for reducing variation among the in-cylinder injection valves 26. The fuel injection amount for the last fuel injection (expansion stroke fuel injection amount Qend) can thus be set to a more appropriate amount. On the other hand, the fuel injection amounts Qn for the first to Nth fuel injections other than the last fuel injection (fuel injection in the expansion stroke) are corrected by the air-fuel ratio feedback control and are also corrected by the learning value kinj for reducing variation among the in-cylinder injection valves 26. Accordingly, the air-fuel ratio AF from the air-fuel ratio sensor 35*a* can be controlled to the desired air-fuel ratio AF*, and the fuel injection amounts Qn for the first to Nth fuel injections can be set to more appropriate amounts.

In the engine device 10 of the embodiment, when it is necessary to correct each of the fuel injection amounts for the first to Nth fuel injections to a larger amount based on the air-fuel ratio AF from the air-fuel ratio sensor 35*a*, the fuel injection amount for the last fuel injection (expansion stroke fuel injection amount Qend) is also corrected to a larger amount. In this case, the amount by which the fuel injection amount for the last fuel injection (expansion stroke fuel injection amount Qend) is increased by the correction is set so that the higher the coolant start temperature Tws, the larger the amount by which the fuel injection amount for the last fuel injection (expansion stroke fuel injection amount Qend) is increased by the correction tends to be, so that the longer the post-start time Taft, the smaller the amount by which the fuel injection amount for the last fuel injection (expansion stroke fuel injection amount Qend) is increased by the correction tends to be, and so that the higher the volumetric efficiency KL, the larger the amount by which the fuel injection amount for the last fuel injection (expansion stroke fuel injection amount Qend) is increased by the correction tends to be. Even when it is necessary to correct each of the fuel injection amounts for the first to Nth fuel injections to a larger amount based on the air-fuel ratio AF from the air-fuel ratio sensor 35*a*, the fuel injection amount for the last fuel injection (expansion stroke fuel injection amount Qend) may not be corrected to a larger amount.

In the engine device 10 of the embodiment, when the exhaust gas control device 34 is warmed up by the expansion stroke injection warm-up, the fuel injection amount for the last fuel injection (expansion stroke fuel injection amount Qend) is set based on the coolant start temperature Tws, the post-start time Taft, and the volumetric efficiency KL. However, the fuel injection amount for the last fuel injection (expansion stroke fuel injection amount Qend) may also be set based on the coolant start temperature Tws, the post-start time Taft, and the volumetric efficiency KL in cases other than the case where the exhaust gas control device 34 is warmed up by the expansion stroke injection warm-up, such as the case where the last fuel injection is performed in the compression stroke at the start of the engine 12 etc.

The engine device 10 of the embodiment may be mounted on, e.g., an automobile having an automatic transmission in a rear stage, or may be mounted on a hybrid vehicle together with a motor that outputs power for traction.

The correspondence between the main elements of the embodiment and the main elements of the present disclosure described in the summary is shown by way of example in order to specifically describe the modes for carrying out the present disclosure described in the summary. Therefore, the embodiment is not intended to limit the elements of the present disclosure described in the summary. That is, the present disclosure described in the summary should be construed based on the description in the summary, and the embodiment is merely a specific example of the present disclosure described in the summary.

Although the mode for carrying out the present disclosure is described above by using the embodiment, it should be understood that the applicable embodiment is not limited to the embodiment and the present disclosure may be carried out in various modes without departing from the sprit and scope of the present disclosure.

The present disclosure can be used in, e.g., the manufacturing industry of engine devices.

What is claimed is:

1. An engine device, comprising:

an engine including an in-cylinder injection valve configured to spray fuel into a combustion chamber and a spark plug configured to ignite the fuel sprayed from the in-cylinder injection valve;

an exhaust gas control device including an exhaust gas control catalyst configured to control exhaust gases from the engine; and a controller configured to control a plurality of fuel injections from the in-cylinder injection valve and ignition by the spark plug, the controller being configured to perform a last fuel injection from the in-cylinder injection valve in an expansion stroke, and the controller being configured to set a fuel injection amount for the last fuel injection in expansion stroke injection driving, based on a coolant start temperature, post-start time, and volumetric efficiency, the coolant start temperature being a temperature of a coolant for the engine when the engine is started, the post-start time being time elapsed since the start of the engine, the volumetric efficiency being a ratio of a volume of air actually drawn in one cycle to a stroke volume per cycle of the engine, and the expansion stroke injection driving being a control that is performed by performing the ignition by the spark plug in synchronization with the fuel injection in the expansion stroke.

2. The engine device according to claim 1, wherein the controller is configured to set the fuel injection amount for the last fuel injection in the expansion stroke injection driving in such a manner that the higher the coolant start temperature, the larger the fuel injection amount for the last fuel injection tends to be, that the longer the post-start time, the smaller the fuel injection amount for the last fuel injection tends to be, and that the higher the volumetric efficiency, the larger the fuel injection amount for the last fuel injection tends to be.

3. The engine device according to claim 1, wherein the controller is configured to control an opening degree of the in-cylinder injection valve to fully open for the fuel injections other than the last fuel injection in the expansion stroke injection driving, and to control the opening degree of the in-cylinder injection valve to partially open for the last fuel injection.

4. The engine device according to claim 1, wherein:

the controller is configured to correct fuel injection amounts for the fuel injections other than the last fuel injection in the expansion stroke injection driving by air-fuel ratio feedback control; and the controller is configured not to correct the fuel injection amount for the last fuel injection in the expansion stroke injection driving by the air-fuel ratio feedback control.

* * * * *